US007196279B1

(12) United States Patent
Roberts

(10) Patent No.: US 7,196,279 B1
(45) Date of Patent: Mar. 27, 2007

(54) REGULATOR BYPASS SWITCH ASSEMBLY

(75) Inventor: Gerald B. Roberts, Paris, MO (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 11/297,806

(22) Filed: Dec. 9, 2005

(51) Int. Cl.
*H01H 31/00* (2006.01)

(52) U.S. Cl. ..... 200/48 R; 200/48 KB

(58) Field of Classification Search ..... 200/48 R, 200/48 KB, 50.01–50.4, 48 A, 48 P, 48 SB; 218/12, 14, 15, 152; 361/601, 602
See application file for complete search history.

(56) References Cited

U.S. PATENT DOCUMENTS

| | | | | |
|---|---|---|---|---|
| 2,714,646 | A | 8/1955 | Jamison | |
| 2,879,348 | A | 3/1959 | Ortwig | |
| 3,071,662 | A | 1/1963 | Field | |
| 3,103,560 | A | 9/1963 | Bridges | |
| 3,255,322 | A | 6/1966 | Ball | |
| 3,274,364 | A | 9/1966 | Sullivan | |
| 3,590,178 | A | 6/1971 | Kuhn | |
| 4,536,822 | A | 8/1985 | Osborne | |
| 4,681,990 | A | 7/1987 | Osborne | |
| 4,707,574 | A | 11/1987 | Smith | |
| 4,713,500 | A * | 12/1987 | Osborne | 200/48 KB |
| 6,525,274 | B1 * | 2/2003 | Roberts | 200/48 R |
| 6,936,779 | B2 * | 8/2005 | Rhein et al. | 200/48 R |

OTHER PUBLICATIONS

A.B. Chance Co., Chance Type "RT2" Regulator By-Pass Switch, 7.5 to 23 KV—600 AMPS; Section 280, Apr. 1, 1964.

* cited by examiner

*Primary Examiner*—Elvin Enad
*Assistant Examiner*—M. Fishman
(74) *Attorney, Agent, or Firm*—Marcus R. Mickney; Alfred N. Goodman; Mark S. Bicks

(57) ABSTRACT

A bypass blade is pivotably connected to the first terminal pad, and movable between open and closed positions. The bypass blade is electrically connected between the first and third terminal pads when in the closed position. A first disconnect blade is pivotally connected to a second terminal pad and movable between open and closed positions. The first disconnect blade is electrically connected between the first and second terminal pads when in the closed position. A second disconnect blade is pivotally connected to a fourth terminal pad and movable between open and closed positions. The second disconnect blade is electrically connected between the third and fourth terminal pads when in the closed position. An interrupter lever is connected to an interrupter and electrically connected to the third terminal pad. A hook ring is connected to the first and second disconnect blades. The hook ring is movable between closed and open positions. Moving the hook ring from the closed position to the open position moves the first and second disconnect blades from the closed position to the open position, moves the bypass blade from the open position to the closed position and moves the interrupter lever to trip the interrupter internally to break a residual current path between the second disconnect blade and the third terminal pad.

13 Claims, 14 Drawing Sheets

REGULATOR BYPASS SWITCH ASSEMBLY

FIELD OF THE INVENTION

The present invention relates to a regulator bypass switch assembly. More particularly, the present invention relates to a regulator bypass switch assembly in which a single pull or push operates the switch blades in proper sequence. Still more particularly, the present invention relates to a substation or distribution class system having a regulator bypass switch assembly in which a single pull or push operates the switch blades in proper sequence to isolate the regulator from or connect the regulator to the circuit.

BACKGROUND OF THE INVENTION

Regulators mounted to support structures and electrically connected to electrical power distribution systems regulate voltage in the system to prevent overvoltage and undervoltage conditions despite varying load conditions. Regulators may also be used to control voltage during peak and reduced demand periods to optimize operating conditions.

Bypass switch assemblies may be used to provide an economical and practical method of bypassing current and disconnecting regulators to provide maintenance to the regulators without interrupting electrical service provided by the electrical distribution system. Once the regulator has been isolated from the electrical distribution system, maintenance may be performed on the regulator without impairing continuous electrical power.

Switch assemblies are generally used to isolate and connect regulators from and to the electrical distribution system. Typically, existing switch assemblies require multiple operations to open and close the required blades to isolate and connect the regulator from the electrical system while maintaining continuous electrical power. Requiring multiple operations to open and close various blades is inefficient and increases the amount of time needed to isolate or connect the regulator. Moreover, multiple blade operations may result in an operator inadvertently forgetting to open or close one of the blades, thereby not isolating or connecting the regulator from or to the electrical system or not maintaining a continuous supply of electrical power. While not maintaining a continuous supply of electrical power is inconvenient to those relying on the supply of electrical power, not isolating the regulator from the system could be highly dangerous to the operator providing maintenance to the regulator. A need exists for a regulator bypass switch assembly that moves all the blades in a single operation, thereby reducing the likelihood of operator error and operator injury.

Interrupters are often used in these systems to interrupt expected regulator exciting currents during bypass operation. Residual current often resides between the load side disconnect blade and its mating contact through the interrupter. A need exists for a regulator bypass switch assembly that breaks this current path without requiring additional operations by the operator.

Therefore, a need exists for improved regulator bypass switch assemblies.

SUMMARY OF THE INVENTION

Accordingly, it is an objective of the present invention to provide a regulator bypass switch assembly in which a single operation moves all the blades of the switch assembly to either isolate or connect the regulator from or to the electrical distribution system, thereby eliminating the risk of inadvertently forgetting to move a blade to its correct position by the operator.

Accordingly, another objective of the present invention is to provide a regulator bypass switch assembly that substantially eliminates residual current between the load side disconnect blade and its mating contact.

The foregoing objectives are basically attained by providing a bypass switch assembly. A bypass blade is pivotally connected between first and third terminal pads, and movable between open and closed positions. The bypass blade is electrically connected between the first and third terminal pads when in the closed position. A first disconnect blade is pivotally connected to a second terminal pad and movable between open and closed positions. The first disconnect blade is electrically connected between the first and second terminal pads when in the closed position. A second disconnect blade is pivotally connected to a fourth terminal pad and movable between open and closed positions. The second disconnect blade is electrically connected between the fourth and third terminal pads when in the closed position. An interrupter lever is the operating means of an interrupter connected to the third terminal pad. A pull-ring is connected to the second disconnect blade. The pull-ring is pivotable between closed and open stops. Moving the pull-ring from the closed stop to the open stop starts movement of the first and second disconnect blades from the closed position to the open position. Continued movement moves the bypass blade from the open position to the closed position and moves the interrupter lever to trip the interrupter internally to break a residual current path between the second disconnect blade and the third terminal pad.

The foregoing objectives are also basically attained by providing a method of isolating an electrical device in an electrical distribution system. First and second disconnect blades are electrically disengaged from first and third terminal pads. A residual current is broken between the second disconnect blade and the third terminal pad by tripping an interrupter. A bypass blade is electrically engaged with a bypass contact to create a bypass electrical path from the first terminal pad to the third terminal pad to isolate the electrical device from the electrical distribution system. These steps are performed by a single operation of pulling a pull ring downwardly with a tool, such as an insulated hookstick operating tool.

Other objects, advantages and salient features of the invention will become apparent from the following detailed description, which, taken in conjunction with the annexed drawings, discloses exemplary embodiments of the invention.

BRIEF DESCRIPTION OF THE DRAWINGS

Referring now to the drawings that form a part of the original disclosure.

Throughout the drawings, like reference numerals will be understood to refer to like parts, components and structures.

DETAILED DESCRIPTION OF THE INVENTION

Figure 1:
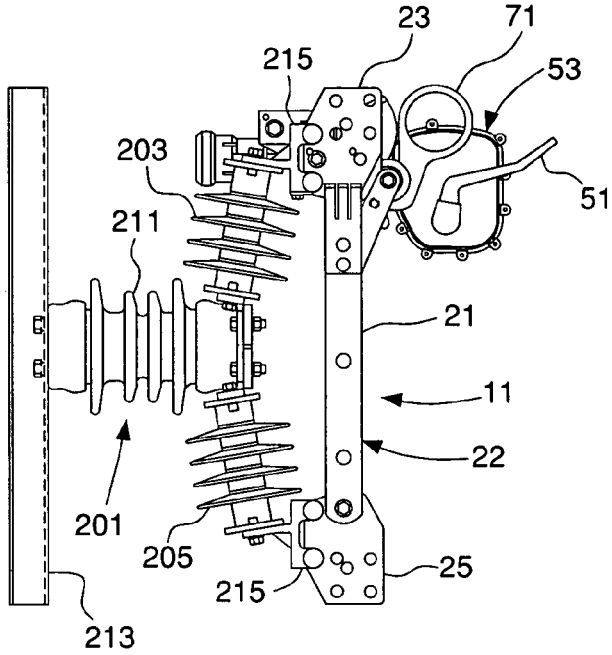
FIG. 1 is a left side elevational view of a station class bypass switch assembly according to an embodiment of the present invention.
Figure 2:
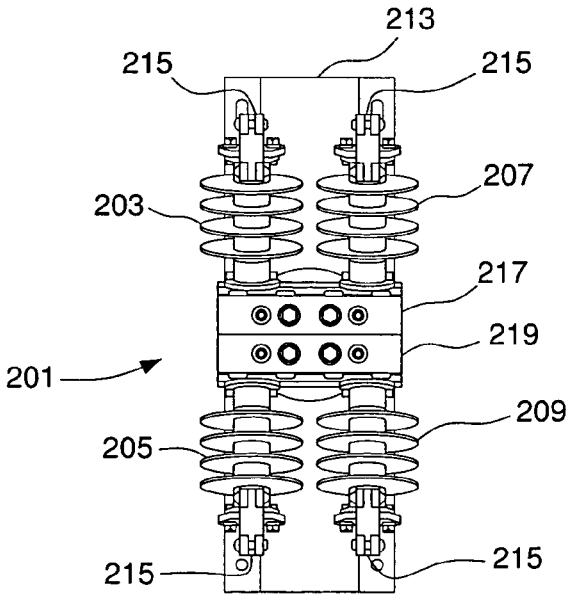
FIG. 2 is a front elevational view of the station class bypass switch assembly of FIG. 1 showing a base, insulators and insulator adapters used to support current carrying parts.
Figure 3:
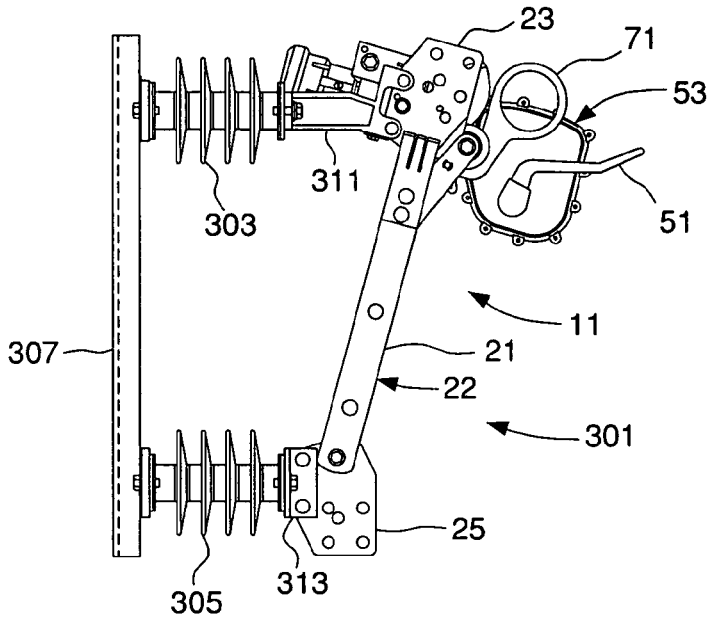
FIG. 3 is a left side elevational view of a distribution class bypass switch assembly according to another embodiment of the present invention.
Figure 4:
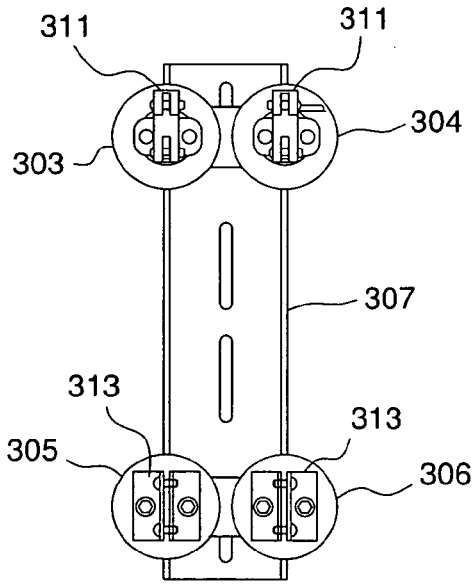
FIG. 4 is a front elevational view of the distribution class bypass switch assembly of FIG. 3 showing a base, insulators and insulator adapters used to support current carrying parts.

As shown in FIGS. 1 and 3, the present invention relates to station and distribution class regulator bypass switch assemblies, respectively. As shown in FIGS. 2 and 4, the present invention relates to the base, insulators and current carrying parts mounting adapters relative to station and distribution class switch assemblies, respectively. FIGS. 1 and 2 show a station class bypass switch assembly 201. FIGS. 3 and 4 show a distribution class bypass switch assembly 301. FIGS. 5–39 relate to both the station and distribution class bypass switch assemblies.

FIGS. 1–2 show a regulator bypass switch assembly 11 according to an exemplary embodiment of the present invention being used with a station class system 201. FIGS. 3–4 show the regulator bypass switch assembly 11 being used with a distribution class system 301 according to another exemplary embodiment of the present invention. The regulator bypass switch assemblies 11 used with the distribution and substation systems are substantially structurally similar and operate in substantially similar manners.

The station class system 201, as shown in FIGS. 1–2, has four insulators 203, 205, 207 and 209 secured to a fifth insulator 211. The regulator bypass switch current carrying parts assembly 22 is secured to the four insulators. Insulator adapters 215 secure each of the terminal pads 23, 25, 33 and 35 to one of the four insulators 203, 205, 207 and 209, as shown in FIGS. 1–2. Two of the insulators 203 and 207 are connected to a first mounting member 217, and the other two insulators 205 and 209 are connected to a second mounting member 219. The first and second mounting members 217 and 219 are connected to the fifth insulator 211. The fifth insulator 211 is secured to a mounting base 213. The mounting base 213 is secured to a support structure (not shown).

The distribution class system 301, as shown in FIGS. 3–4, has four insulators 303, 304, 305 and 306. The regulator bypass current carrying parts switch assembly 22 is secured to the four insulators. Two of the insulators 303 and 304 are connected by first insulator adapters 311 to the first and third terminal pads 23 and 33, respectively. The other two insulators 305 and 306 are connected by second insulator adapters 313 to the second and fourth terminal pads 25 and 35, respectively. Each of the four insulators 303, 304, 305 and 306 is secured to a mounting base 307, which is secured to a support structure (not shown). Preferably, the first insulator adapters 311 are longer than the second insulator adapters 313 to provide the first and second disconnect blades 21 and 31 at an angle to the mounting bracket 307, as shown in FIG. 3, thereby facilitating the opening and closing operations. Distribution switches are normally mounted at greater heights than station switches. Therefore, the live current carrying parts assembly 22 being set out at an angle makes switch operation easier. In the absence of this feature, a bracket may be added between the switch mounting base 307 and the support structure to angle the live current carrying parts assembly 22.

Figure 6:
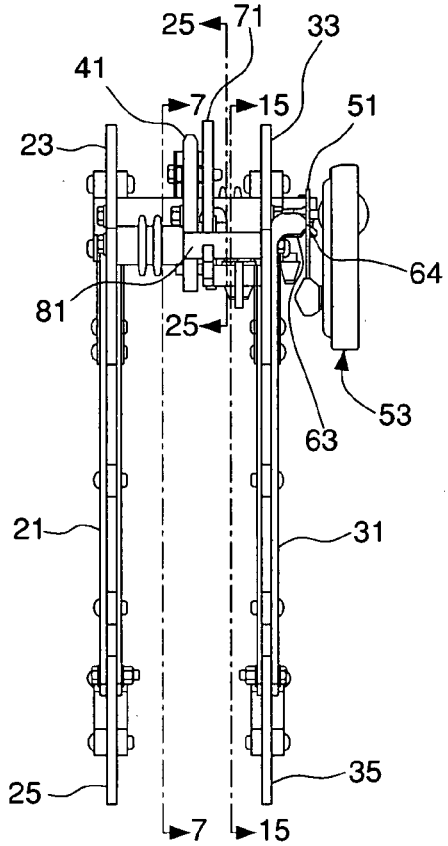
FIG. 6 is a front elevational view of the current carrying parts of FIG. 5.
Figure 7:
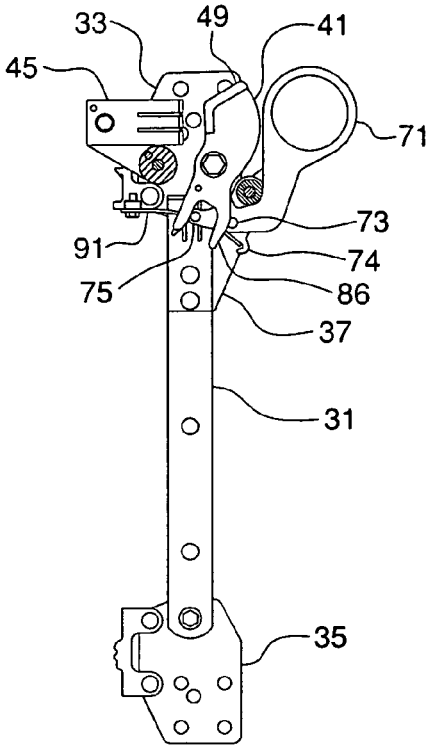
FIG. 7 is a left side elevational view in partial cross section on line 7—7 of FIG. 6 showing disconnect blades closed and a bypass blade opened.

As shown in FIGS. 5–39, the present invention relates to the current carrying parts switch assembly 22 mountable to both station and distribution class regulator bypass switch assemblies 201 and 301, respectively. A bypass blade 41 (FIGS. 7 and 25) is pivotably connected to the third terminal pad 33, and movable between open and closed positions (FIGS. 7 and 11, respectively). The bypass blade 41 is electrically connected between the first and third terminal pads 23 and 33 when in the closed position, as shown in FIG.

11. A first disconnect blade 21 is pivotally connected to a second terminal pad 25 and movable between open and closed positions. The first disconnect blade 21 is electrically connected between the first and second terminal pads 23 and 25 when in the closed position. A second disconnect blade 31 is pivotally connected to a fourth terminal pad 35 and movable between open and closed positions (FIGS. 11 and 7, respectively). The second disconnect blade 31 is electrically connected between the fourth and third terminal pads 35 and 33, respectively, when in the closed position. An interrupter lever 51 is connected to and operates an interrupter 53 connected to the third terminal pad 33, as shown in FIGS. 21–24. A pull-ring 71 is pivotably connected to the second disconnect blade 31, as shown in FIGS. 7–14. The pull-ring 71 is movable between closed and open positions (FIGS. 7 and 11, respectively). Moving the pull-ring 71 from the closed position to the open position moves the first and second disconnect blades 21 and 31 from the closed position to the open position, moves the bypass blade 41 from the open position to the closed position and moves the interrupter lever 51 to trip the interrupter 53 internally to break a residual current path between the second disconnect blade 31 and the third terminal pad 33.

Figure 36:
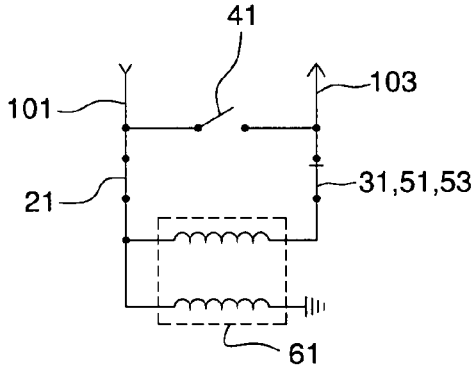
FIG. 36 is a circuit diagram of a regulator bypass switch assembly for either a distribution or station class system in normal operation with the disconnect blades closed and the bypass blade open such that the regulator is connected in the circuit.
Figure 39:
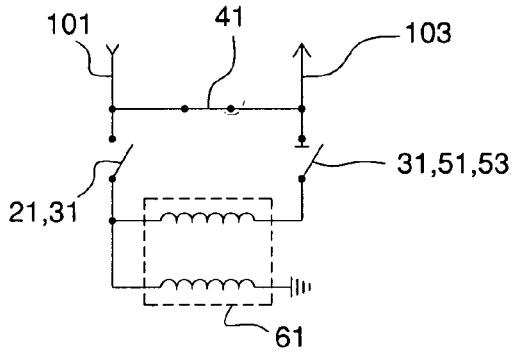
FIG. 39 is a circuit diagram of the regulator bypass switch assembly of FIG. 38 showing the disconnect blades opened, the bypass blade closed, and the interrupter out of the circuit such that the regulator is isolated from the circuit.

A schematic diagram of the electrical distribution system is shown in FIGS. 36–39. Electricity is supplied from the source side 101. In normal operation, the bypass blade 41 is open, the first and second disconnect blades 21 and 31 are closed, and the interrupter is out of the circuit (FIG. 36). Electricity flows through the first disconnect blade 21 to the regulator 61, and then through the second disconnect blade 31 to the load side 103 (FIG. 36). To isolate the regulator 61, the bypass blade 41 is closed (FIG. 37), the first and second disconnect blades 21, 31 are opened (FIG. 38), and the interrupter lever 51 is pulled open to trip the interrupter 53 internally to break the current path between the second disconnect blade 31 and the terminal pad 33 (FIG. 39).

An interrupter 53 having an interrupter lever 51 is connected to the third terminal pad 33, as shown in FIGS. 21–24. The interrupter interrupts regulator exciting currents during bypass operation.

Figure 5:
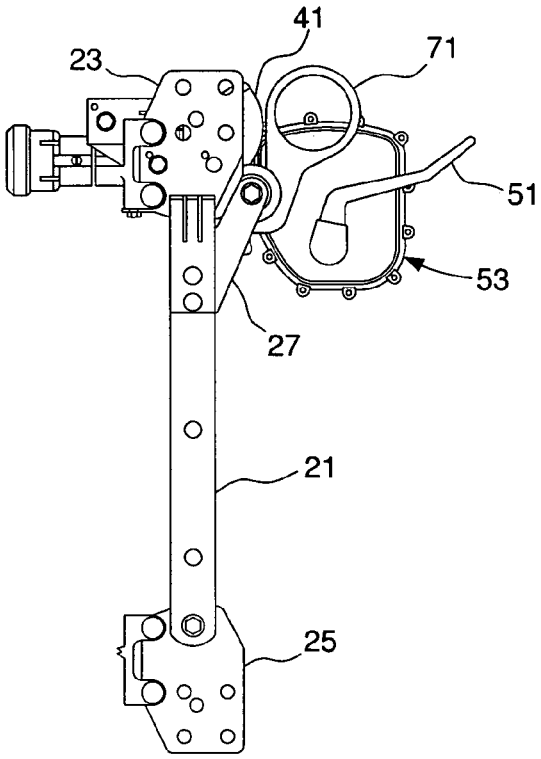
FIG. 5 is a left side elevational view of the current carrying parts of FIGS. 1 and 3.

The regulator bypass switch assembly 11 includes a first disconnect blade 21 pivotally connected to the second terminal pad 25 and movable between closed and open positions. In the closed position, as shown in FIGS. 5 and 6, the first disconnect blade is in electrical contact with the first terminal pad 23 to create an electrical path between the first and second terminal pads, as shown in FIG. 36. In the open position, as shown in FIG. 39, the first disconnect blade 21 is pivoted about its connection to the second terminal pad 25 such that it is electrically separated from the first terminal pad 23, thereby breaking the electrical current path between the first and second terminal pads.

The second disconnect blade 31 is pivotally connected to the fourth terminal pad 35 and movable between closed and open positions. When in the closed position, as shown in FIG. 7, the second disconnect blade is in electrical contact with the third terminal pad 33 to create an electrical path between the third and fourth terminal pads, as shown in FIG. 36. In the open position, as shown in FIGS. 11 and 39, there is no electrical path between the first and second or the third and fourth terminal pads. In the open position, as shown in FIGS. 11 and 39, the second disconnect blade 31 is pivoted about its connection to the fourth terminal pad 35 such that it is electrically separated from the third terminal pad 33, thereby breaking the electrical current path between the third and fourth terminal pads.

A conductor from the source side 101 is electrically connected to the first terminal pad 23. A conductor from the load side 103 is electrically connected to the third terminal pad 33. An electrical device, such as a regulator 61, is electrically connected between the second and fourth terminal pads 25 and 35. Preferably, the first, second, third and fourth terminal pads have a plurality of fastener holes adapted to terminate conductors in a plurality of different angles.

Figure 27:
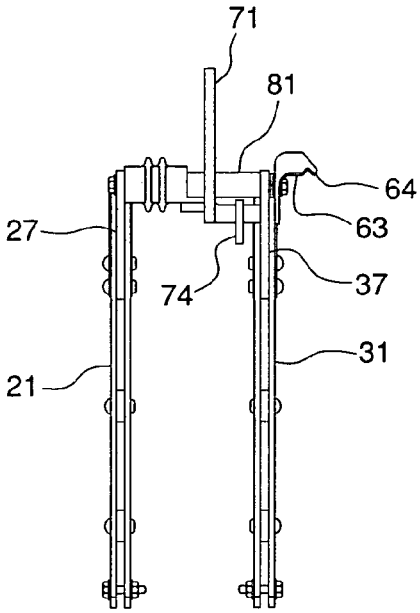
FIG. 27 is a front elevational view of the disconnect blades of FIG. 6 separated from the switch assembly.
Figure 28:
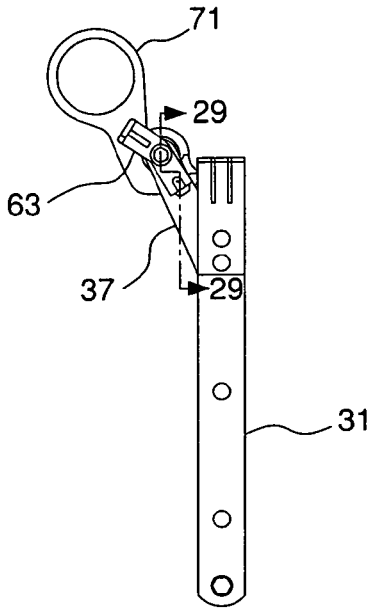
FIG. 28 is a right side elevational view of the disconnect blades of FIG. 27.

A first arm 27 is connected proximal the free end of the first disconnecting blade 21, as shown in FIG. 5. A second arm 37 is connected proximal the free end of the second disconnecting blade 31, as shown in FIG. 7. A connecting rod 81 extends between the first and second arms 27 and 37 to move the first and second disconnect blades 21 and 31 simultaneously. Preferably, the connecting rod 81 is insulated, as shown in FIG. 27.

Figure 25:
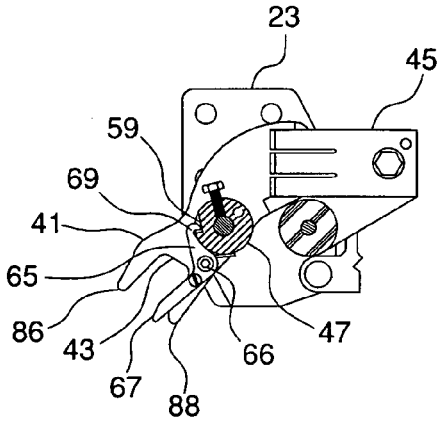
FIG. 25 is a right side elevational view in partial cross section on line 25—25 of FIG. 6 showing the bypass blade latch.

A bypass blade 41 (FIG. 25) is electrically connected between the first and third terminal pads 23 and 33, as shown in FIG. 39. When in normal operation, the bypass blade 41 is in the open position, as shown in FIGS. 7 and 36. In bypass mode, the bypass blade 41 is rotated to the closed position, as shown in FIGS. 11, 25 and 39, thereby creating an electrical path between the first and third terminal pads 23 and 33, respectively. The bypass blade 41 is pivotally connected to the bypass pivot support 47 that is connected to the third terminal pad 33. The bypass blade 41 has a contact end 49, which is preferably beveled, (FIGS. 8 and 9) adapted to engage the bypass contact 45. Preferably, the bypass blade 41 rotates to engage the bypass contact 45 at an angle to facilitate rotation of the bypass blade, as well as facilitating ice breaking during inclement weather conditions. When in the closed position (FIG. 25), an electrical path from the first and third terminal pads is created that bypasses the electrical device (FIG. 39). A recessed portion 59 of the bypass blade pivot support 47 is aligned with a latch end 69 of a locking latch 65, as shown in FIG. 25.

Figure 26:
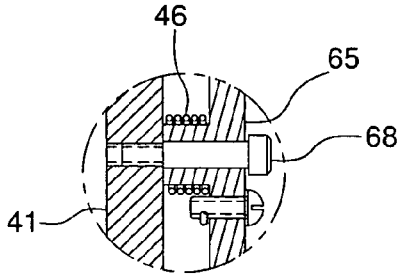
FIG. 26 is an enlarged front elevational view of the bypass blade torsional spring and blade latch pivot of FIG. 25.

A locking latch 65, as shown in FIG. 25, is adapted to prevent movement of the bypass blade 41 when in the closed position. A recess 59 in the pivot support 47 is adapted to receive the hooked end 69 of the locking latch 65 to prevent rotation of the bypass blade 41. The locking latch 65 is pivotally connected to the bypass blade 41 by pivot point 68. A free end 67 of the locking latch 65 is adapted to be engaged by the pull-ring 71 to remove the locking end 69 of the locking latch from the recess 59 in the pivot support 47. The locking latch 65 may be connected to the bypass blade 41 with a torsional spring 46 at the pivot point 68 to bias against recessed portion 59, as shown in FIG. 26.

Figure 10:
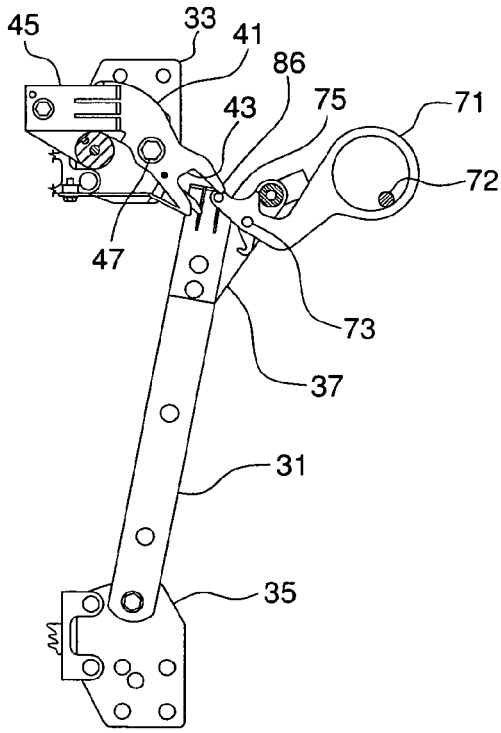
Figure 11:
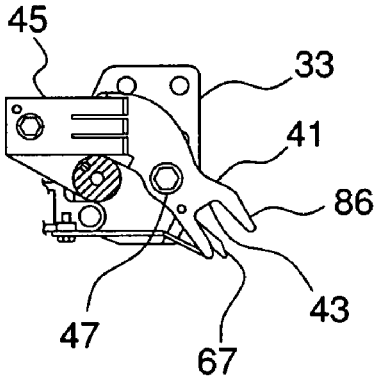
Figure 11:
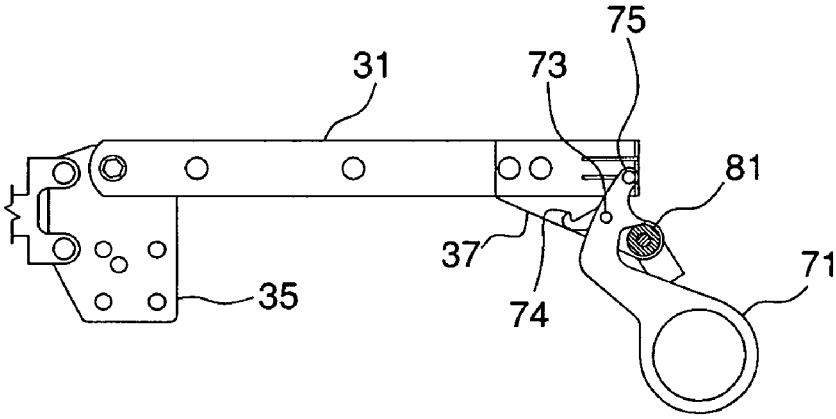
Figure 29:
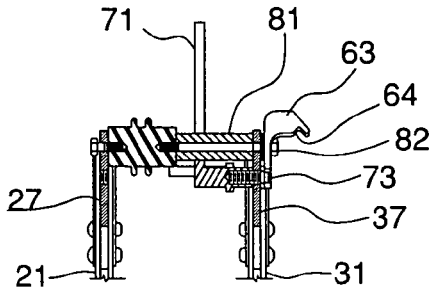
FIG. 29 is a front elevational view in partial cross section taken along line 29—29 of FIG. 28 showing the assembly of FIG. 28.

A pull-ring 71 (FIGS. 30 and 31) is preferably connected to the second arm 37 of the second disconnect blade 31, as shown in FIG. 10. The pull-ring 71 is adapted to receive an end of a hookstick 72 to pull and push the pull-ring between closed and open positions (FIGS. 7 and 11, respectively). Preferably, the pull-ring 71 is pivotally connected to second arm 37 about a pivot point 73, as shown in FIGS. 10 and 29. The pull-ring 71 has a finger 75 to engage a bypass blade 41 to open and close the bypass blade 41 and a hook member 74 (FIGS. 32–34) adapted to engage a latch member 91 to prevent accidental movement of the pull-ring in the closed position (FIG. 7). The hook member 74 has a latching hook end 78 and a pryout hook end 76, as shown in FIGS. 15–20 and 30.

A deflector 63 is secured to the second disconnect blade 31, as shown in FIG. 29. Preferably, the deflector 63 is connected on the opposite side of second arm 37 than the pull ring 71, as shown in FIG. 29. Preferably, the deflector 63 is connected to the connecting rod 81 and aligned by a pivot bolt 82. A recess 64 in the deflector 63 is adapted to engage the interrupter lever 51 of the interrupter 53.

Figure 20:
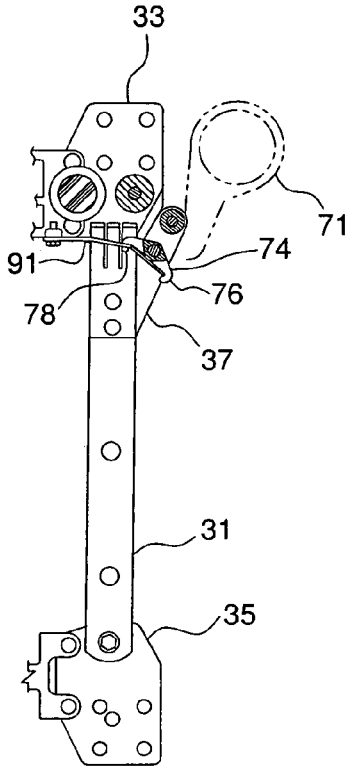
Figure 30:
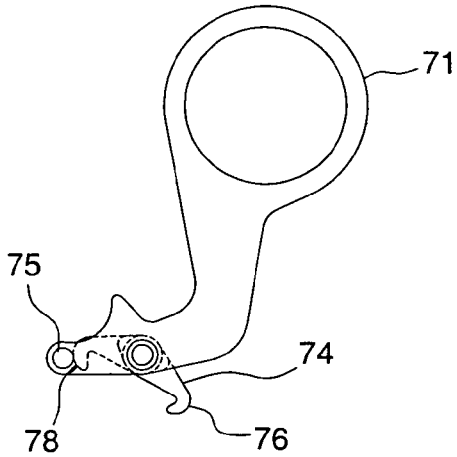
FIG. 30 is a front elevational view of a pull-ring.
Figure 31:
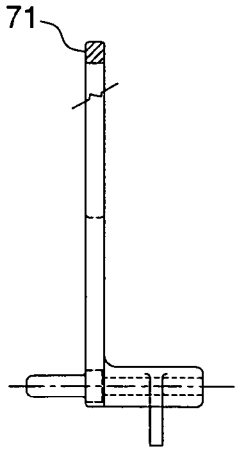
FIG. 31 is a top plan view of the pull ring of FIG. 30.
Figure 32:
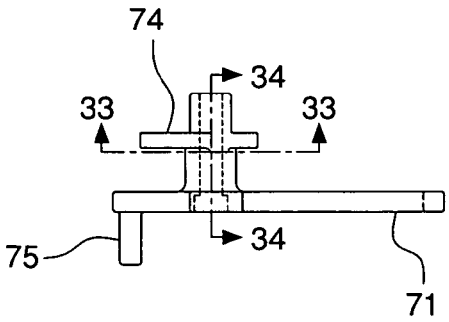
FIG. 32 is a side elevational view of the pull-ring of FIG. 30.
Figure 33:
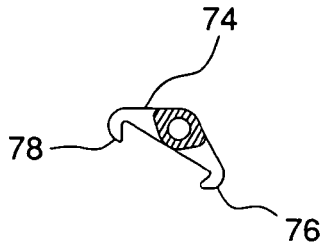
FIG. 33 is a side elevational view in partial cross section taken along line 33—33 of FIG. 32 of the hook member.
Figure 34:
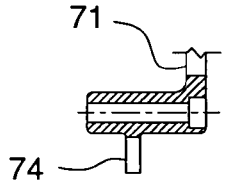
FIG. 34 is a side elevational view in partial cross section taken along line 34—34 of FIG. 32 of the pull-ring.
Figure 35:
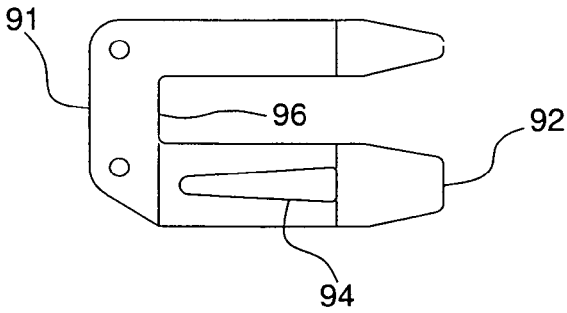
FIG. 35 is a top plan view of the latch member.

A latch member 91 is connected to the third terminal pad 33, as shown in FIGS. 6, 15–20 and 35. Preferably, the latch member 91 is flexible. The latching hook end 78 of the hook member 74, which is connected to the hook ring 71 as shown in FIG. 30, extends through an opening 94 proximal the free end 92 of the latch member 91 to maintain the bypass switch assembly 11 in the normal operating mode (disconnect blades 21 and 31 closed and the bypass blade 41 open) until the pull-ring 71 is operated by a hookstick, as shown in FIG. 20. A recess 96 in the latch member 91 is adapted to receive the second disconnect blade 31.

An electrical device is electrically connected between the second and fourth terminal pads 25 and 35, as shown in FIGS. 36–39. Preferably, the electrical device is a regulator 61.

Assembly, Disassembly and Operation

Electrical circuit diagrams of the regulator bypass switch assembly are shown in FIGS. 36–39. The normal operating mode is shown in FIG. 36. Electrical current is received at the first terminal pad 23 from the source side 101. Since the bypass blade 41 is in the open position, the electrical current is prevented from traveling through the bypass blade. The electrical current is transferred through the first disconnect blade 21, through the electrical device (such as a regulator 61), and through the second disconnect blade 31. The electrical current is transferred through the third terminal pad 33 to the load side 103.

The bypass mode of the regulator bypass switch assembly 11 is shown in FIG. 39. Both the first and second disconnect blades 21 and 31 are in the open position, the interrupter is out of the circuit, and the bypass blade 41 is in the closed position. Since the first disconnect blade 21 is open, electrical current travels through the bypass blade 41 and is then transferred through the third terminal pad to the load side 103, thereby bypassing the electrical device. The bypass mode electrically isolates the electrical device from the electrical distribution system so work may be performed on the electrical device.

FIGS. 7–11 show the second disconnect blade opening to isolate the electrical device and the bypass blade closing to maintain service. To more clearly illustrate the opening process, the first disconnect blade 21 and the interrupter 52 are not shown in FIGS. 7–11. As shown in FIG. 7, the second disconnect blade 31 is in the closed position, and the bypass blade 41 is in the open position, i.e., the normal operating mode. The latching end 78 of the hook member 74, which is connected to the pull ring 71, is received by a slot in the latch member 91 when in the normal operating mode, such that the latch member applies an upward force against the pull ring 71 to maintain the bypass switch assembly 11 in the normal operating mode, as shown in FIG. 20.

Figure 8:
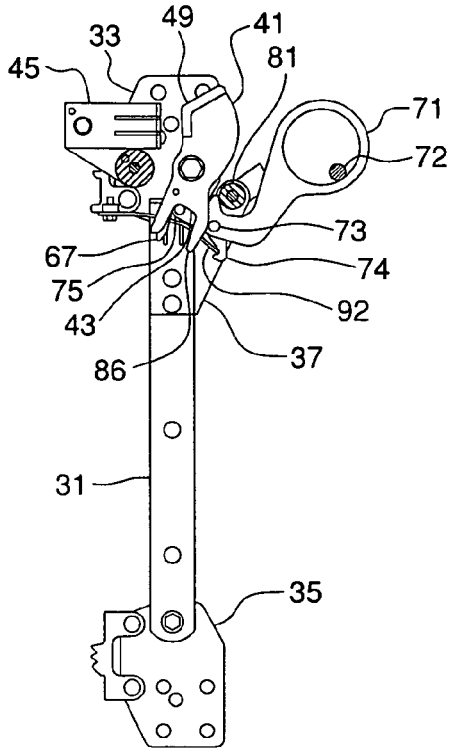
FIGS. 8–11 are left side elevational views showing the opening of the disconnect blades and the closing of the bypass blade of FIG. 7.
Figure 15:
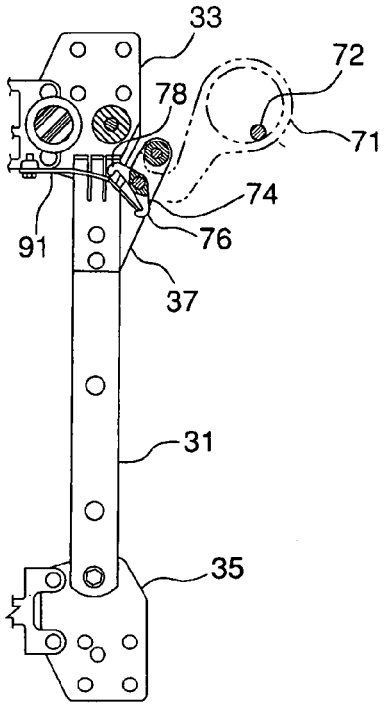
FIGS. 15–17 are left side elevational views in partial cross section on line 15—15 of FIG. 6 showing unlatching and prying out functions during the opening of the disconnect blades and the closing of the bypass blade.
Figure 16:
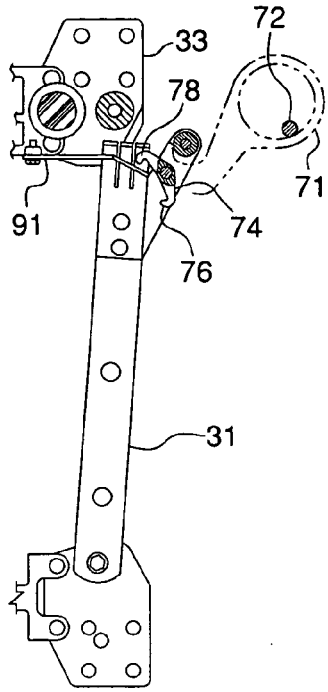
Figure 17:
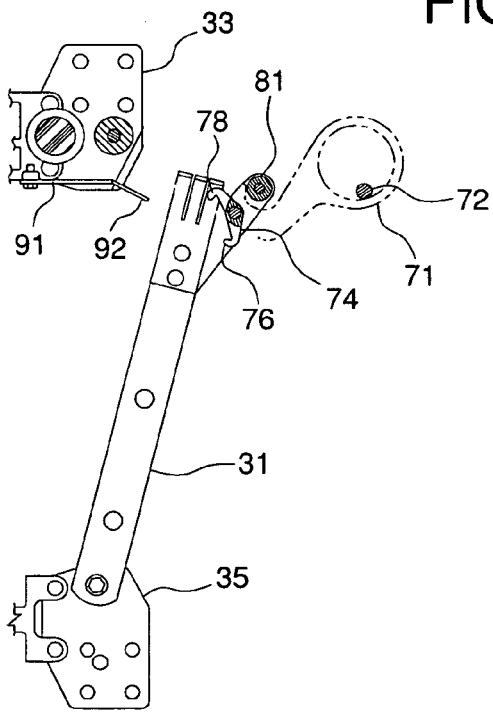
Figure 18:
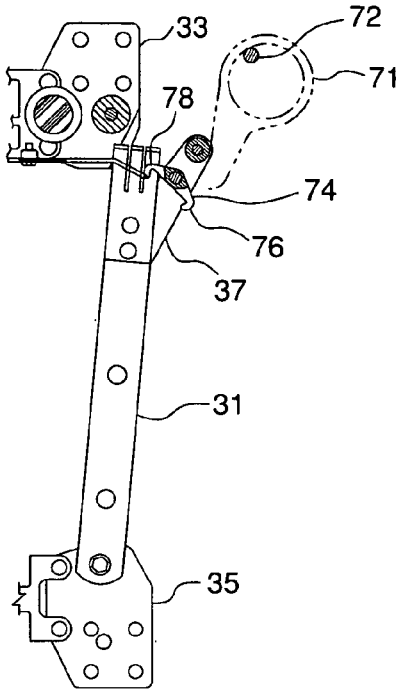
FIGS. 18–20 are left side elevational views showing latching function during closing of the disconnect blades and opening of the bypass blade.
Figure 19:
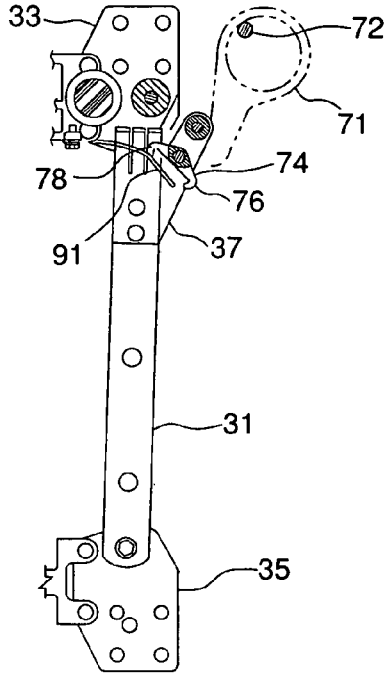

A hookstick 72 is inserted in the pull-ring, as shown in FIG. 8, and pulled downwardly. Initially, the pull-ring 71 pivots about its pivot point 73 on the second arm 37 of second disconnect blade 31. The pivoting of the pull-ring 71 moves the latching end 78 of the hook member 74 of the pull ring out of the opening in the latch member 91, thereby freeing the pull-ring 71 to move and open the disconnect blades 21 and 31, as shown in FIG. 15. The pryout hook end 76 of the hook member 74 rotates against the free end 92 of the latch member 91 to create pryout action to begin rotation of the disconnect blades to the open position, which causes the latch member to flex, as shown in FIG. 8. The flexing of the latch member 91 facilitates a pryout force moving the disconnect blades, particularly when the disconnect blades 21 and 31 are stuck, such as due to being iced up. The pull ring 71 rotates with respect to the connecting rod 81 to further facilitate moving the disconnect blades to the open position. The rotation of the pull ring 71 also rotates the finger 75 further into the recessed portion 43 of the bypass blade 41 (FIG. 8).

Figure 9:
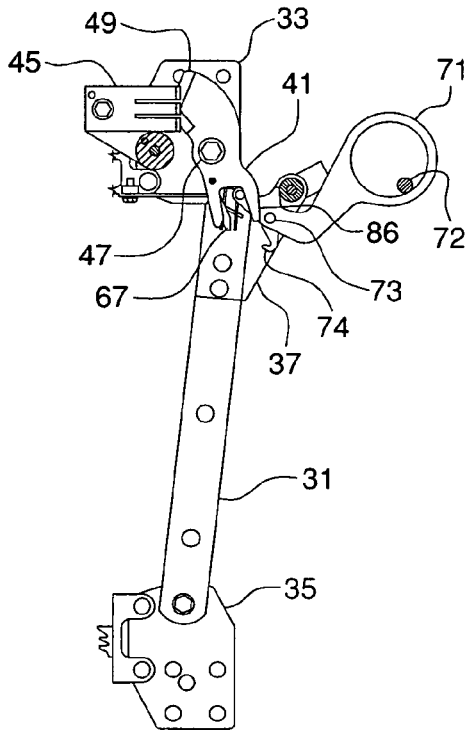
Figure 37:
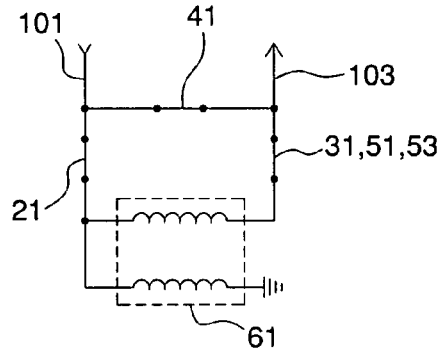
FIG. 37 is a circuit diagram of the regulator bypass switch assembly of FIG. 36 showing the bypass blade closed in parallel with the disconnect blades.
Figure 38:
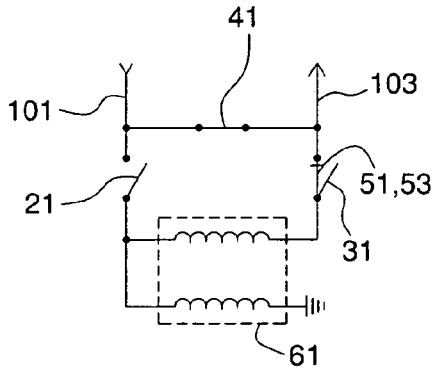
FIG. 38 is a circuit diagram of the regulator bypass switch assembly of FIG. 37 showing the disconnect blades opened and the bypass blade closed and the interrupter in the circuit.

As shown in FIG. 9, the hookstick 72 continues to pull downwardly on the pull ring 71. The downward movement of the pull ring 71 rotates the finger 75 against the opening finger 86 of the bypass blade 41. The bypass blade 41 is rotated about its pivot point 47 due to the finger 74 of the pull-ring engaging the opening finger 86 of the bypass blade. As the bypass blade 41 begins to engage the bypass contact 45, the disconnect blades 21 and 31 are still in contact with the first and third terminal pads 23 and 33, thereby creating a parallel current path, as shown in FIG. 37.

As shown in FIG. 10, the hookstick 72 continues to pull the pull ring 71 downwardly. The finger 75 of the pull ring 71 continues to rotate the bypass blade 41 by engaging the opening finger 86 thereof to completely close the bypass blade. The first and second disconnect blades 21 and 31 are disengaged from the terminal pads 23 and 33.

The hookstick 72 is pulled downwardly to fully open the disconnect blades 21 and 31, as shown in FIG. 11. The hookstick 72 is then removed from the pull ring 71.

Figure 21:
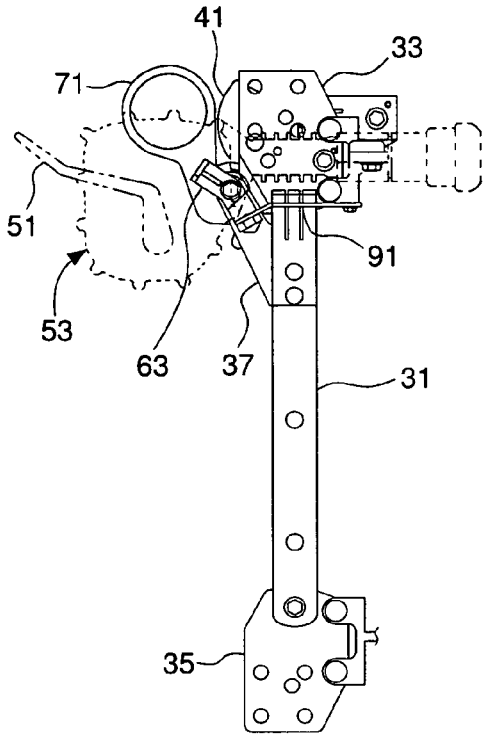
FIGS. 21–24 are right side elevational views of FIG. 6 showing the interrupter and disconnect blades during opening of the disconnect blades and closing of the bypass blade.

FIGS. 21–24 illustrate the deflector 63 engaging the interrupter lever 51 of the interrupter 53 during the opening operation, as shown in FIGS. 21–24, thereby breaking a residual current path between the second disconnect blade 31 and the third terminal pad 33. As shown in FIG. 21, the disconnect blades 21 and 31 are in the closed position and the bypass blade 41 is in the open position, i.e., the normal operating mode.

Figure 22:
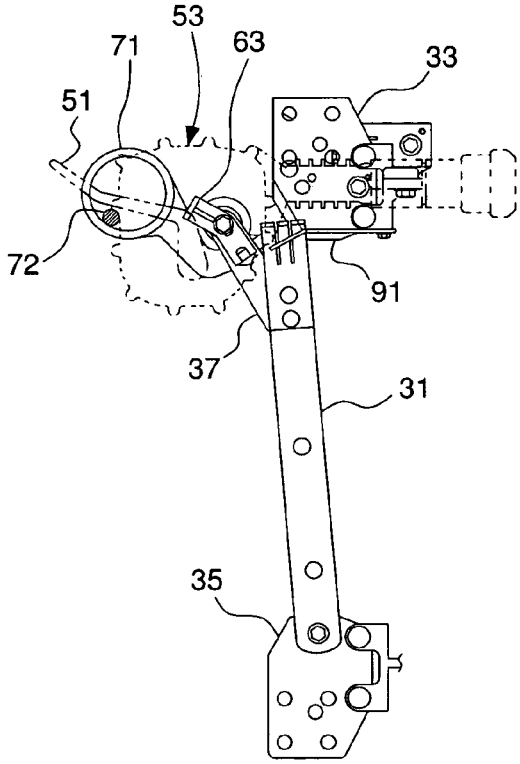

As the pull ring 71 is pulled downwardly by the hookstick 72 during the opening operation to open the disconnect blades 21 and 31 and to close the bypass blade 41, the deflector 63 engages the interrupter lever 51, as shown in FIG. 22. The deflector 63 engages the interrupter lever 51 before the disconnect blades 21 and 31 are fully separated from their respective terminal pads 23 and 33, thereby establishing a parallel electrical path through the interrupter 53. The interrupter lever 51 is in the reset position in FIG. 22. As shown in FIGS. 6 and 29, the deflector 63 has a recess 64 adapted to engage the interrupter lever 51.

Figure 23:
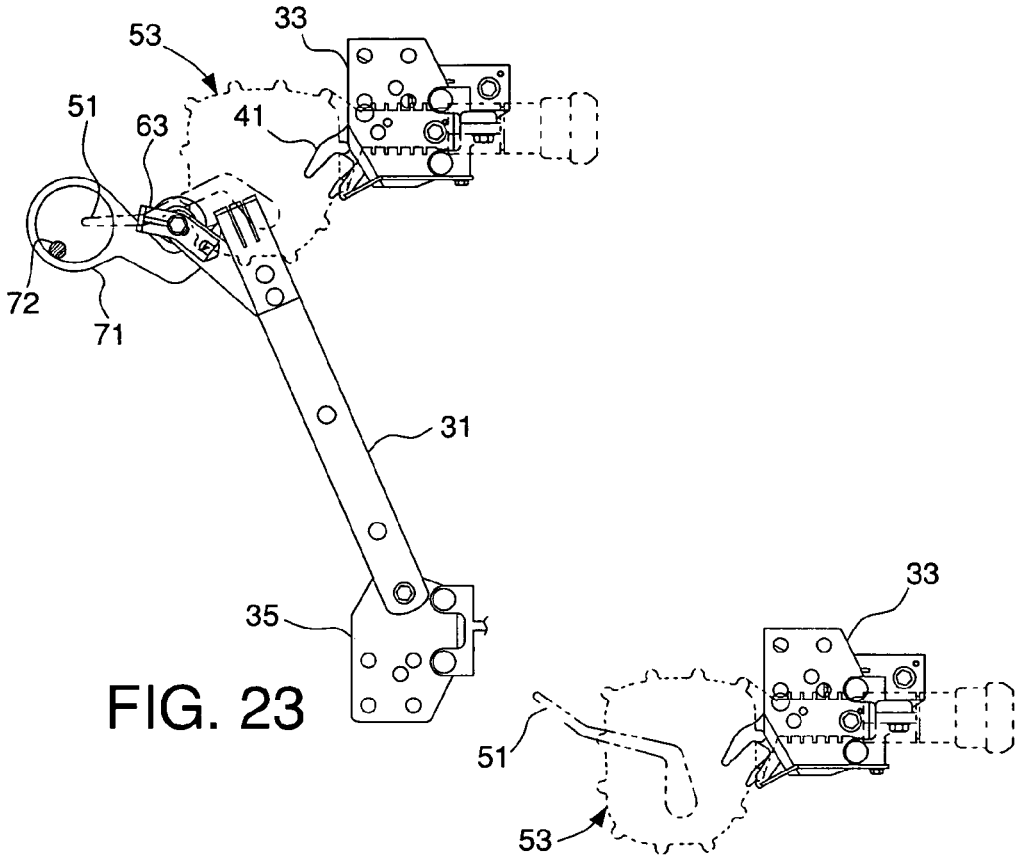

The hookstick 72 is continued to be pulled downwardly, as shown in FIG. 23, to separate the disconnect blades 21 and 31 from their respective terminal pads 23 and 33 and to close the bypass blade 41. An electrical path exists through the second disconnect blade 31, the interrupter lever 51, the interrupter 53 and the third terminal pad 33 (FIG. 23). The parallel electrical path is interrupted when the interrupter lever is rotated into the trip position, as shown in FIG. 23. When the interrupter lever 51 reaches the trip position, the interrupter 53 is tripped internally to break the electrical path therethrough.

Figure 24:
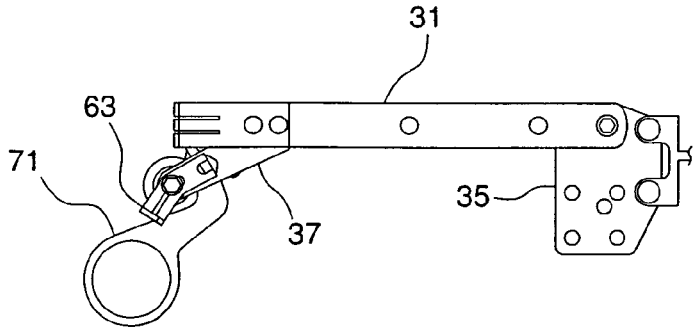

Continued rotation of the pull ring 71 downwardly by the hookstick 72, as shown in FIG. 24, disengages the deflector 63 from the interrupter lever 53. The bypass blade 41 is fully engaged with the bypass contact 45, the disconnect blades 21 and 31 are completely opened and separated from the first and third terminal pads 23 and 33, and the interrupter lever returns to its original reset position, such that the only electrical path is through the closed bypass blade (FIG. 24). Preferably, the interrupter lever is a spring member to facilitate returning the interrupter lever to its original position. Thus, the electrical device, such as regulator 61, is completely isolated from the electrical distribution system. To secure the bypass blade 41 in the closed position, the locking end 69 of the locking latch 65 of the bypass blade 41 engages a recess 59 in the pivot support member 47 of the bypass blade, thereby preventing accidental rotation of the bypass blade to an open position, as shown in FIG. 25.

Figure 12:
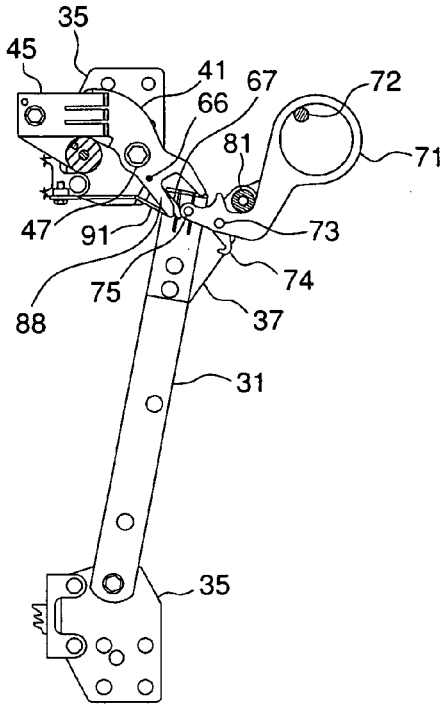
FIGS. 12–14 are left side elevational views showing the closing of the disconnect blades and the opening of the bypass blade of FIG. 7.

The closing operation of the disconnect blades 21 and 31 and the opening of the bypass blade 41 to return the bypass switch assembly 11 to normal operating condition is shown in FIGS. 11–14. The bypass mode of operation is shown in FIG. 11. The hookstick 72 is inserted in the pull ring 71 to push the pull ring upwardly to rotate the pull ring about is pivot point 73. Prior to insertion of the hookstick the pull ring 71 is spaced from the connecting rod 81, as shown in FIG. 11. The pull ring 71 initially rotates about the pivot point 73 to engage the pull ring with the connecting rod 81, as shown in FIG. 12. Further pushing upwardly of the pull ring then rotates the disconnect blades upwardly toward the first and third terminal pads 23 and 33.

Continued pushing upwardly of the pull ring 71 engages the pull ring finger 75 with the free end 67 of the bypass blade locking latch 65, as shown in FIG. 12. During bypass mode operation, as shown in FIG. 25, the locking end 69 of the bypass locking latch 65 engages a recess 59 in the pivot member 47 to maintain the bypass blade 41 in the closed position to prevent accidental opening of the bypass blade. The finger 75 of the pull ring 71 engages the bypass blade locking latch 65 to rotate it about its pivot 66 on the bypass blade 41, thereby freeing the bypass blade to rotate and open the bypass blade.

Figure 13:
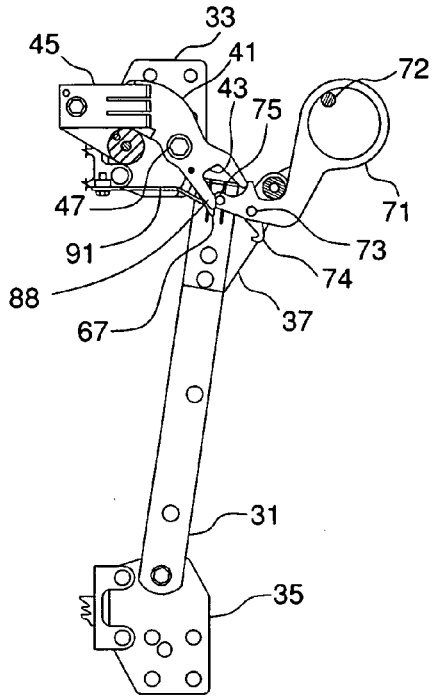

Further pushing the pull ring 71 upwardly with the hookstick 72, as shown in FIG. 13, causes the finger 75 of the pull ring to unlatch the locking end 69 of the locking latch 65 by rotating about its pivot point 66. The locking latch 65 is removed from the pivot member 47, thereby freeing the bypass blade 41 to rotate. Once the locking latch 65 has been unlatched, the finger 75 of the pull ring 71 engages the recessed portion 43 of the bypass blade 41 and pushes against finger 88 to rotate the bypass blade to the open position.

Figure 14:
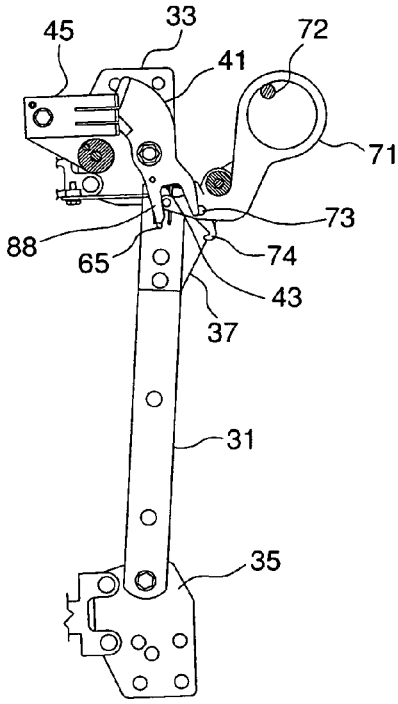

As the pull ring 71 is continued to be pushed upwardly, the disconnect blades 21 and 31 are rotated into engagement with the first and third terminal pads 23 and 33, as shown in FIG. 14. Simultaneously, the bypass blade 41 is rotated away from the bypass contact 45, thereby creating parallel electrical paths through the disconnect blades 21 and 31 and through the bypass blade 41 (FIG. 14).

Further upward pushing of the pull ring 71 fully closes the disconnect blades 21 and 31 and fully opens the bypass blade 41, thereby returning the bypass switch assembly 11 to normal operating mode and restoring the electrical device into the electrical distribution system (FIG. 36). The latching end 78 of the hook member 74 engages the slot 94 in the latch member 91 and the free end 92 of the latch member engages the hook end 76 of the hook member 74, such that the latch member 91 asserts an upward force on the pull ring 71 to prevent accidental rotation of the pull ring to open the disconnect blades 21 and 31. The finger 75 of the pull ring contacts the finger 88 of the bypass blade 41 to prevent accidental closing of the bypass blade, by preventing rotation of the pivot member 47.

While advantageous embodiments have been chosen to illustrate the invention, it will be understood by those skilled in the art that various changes and modifications may be made therein without departing from the scope of the invention as defined in the appended claims.

What is claimed is:

1. A bypass switch assembly, comprising:

a bypass blade electrically connected between first and third terminal pads, and movable between open and closed positions;

a first disconnect blade pivotally connected to a second terminal pad and movable between open and closed positions, said first disconnect blade being electrically connected between said first and second terminal pads when in said closed position;

a second disconnect blade pivotally connected to a fourth terminal pad and movable between open and closed positions, said second disconnect blade being electrically connected between said third and fourth terminal pads when in said closed position;

an interrupter lever connected to an interrupter and electrically connected to said third terminal pad; and a pull-ring connected to said first and second disconnect blade, said pull-ring being movable between closed and open positions, whereby moving said pull-ring from said closed position to said open position moves said first and second disconnect blades from said closed positions to said open positions thereof, moves said bypass blade from said open position to said closed position thereof, and moves said interrupter lever to trip the interrupter internally to break a residual current path between said second disconnect blade and said third terminal pad.

2. The bypass switch assembly according to claim 1, wherein said bypass switch assembly is a station class system in which each of said first, second, third and fourth terminal pads is connected to a substantially similar insulator adapter;

each of said four insulator adapters is connected a substantially similar distribution class insulator;

each of said four distribution class insulators is connected to a first station class insulator; and said first station class insulator is mounted to a base.

3. The bypass switch assembly according to claim 1, wherein said bypass switch assembly is a distribution class system in which said first and third terminal pads are each connected to first insulator adapters and said second and fourth terminal pads are each connected to second insulator adapters, said first insulator adapters being longer than said second insulator adapters to angularly dispose said first and second disconnect blades relative to said base;

each of said first and second insulator adapters is connected to a separate distribution class insulator; and each of said four distribution class insulators is mounted to a base.

4. The bypass switch assembly according to claim 1, wherein an electrical device is electrically connected between said second and fourth terminal pads, said electrical device being electrically isolated when said pull-ring is moved to said open position.

5. The bypass switch assembly according to claim 1, wherein an insulated connecting rod connects said first and second disconnect blades to move said first and second disconnect blades together.

6. The bypass switch assembly according to claim 5, wherein a deflector connected to said second disconnect blade moves said interrupter lever when moving said pull-ring from said closed position to said open position.

7. The bypass switch assembly according to claim 1, wherein a latch member engages said pull ring in said closed position thereof to prevent unintentional movement of said pull-ring.

8. The bypass switch assembly according to claim 7, wherein said latch member is flexible such that movement of said pull-ring by a hookstick out of said closed position thereof frees said pull-ring from said latch member.

9. The bypass switch assembly according to claim 1, wherein a locking latch engages said bypass blade in said closed position thereof to prevent unintentional movement of said bypass blade.

10. The bypass switch assembly according to claim 1, wherein said bypass switch assembly is secured to a support such that said first and second disconnect blades are not parallel to said support.

11. The bypass switch assembly according to claim 1, wherein said first, second, third and fourth terminal pads have a plurality of fastener holes to provide a plurality of conductor termination angles.

12. The bypass switch assembly according to claim 7, wherein said interrupter lever is a spring member deflected by said deflector when said pull-ring is moved to said closed position.

13. The bypass switch assembly according to claim 1, wherein said bypass blade engages a contact when rotated to said closed position, said bypass blade being rotated into said contact at an angle to facilitate bypass blade rotation.

* * * * *